US009435290B2

(12) United States Patent
Fuqua

(10) Patent No.: US 9,435,290 B2
(45) Date of Patent: Sep. 6, 2016

(54) OPPOSED-PISTON ENGINE STRUCTURE WITH A SPLIT CYLINDER BLOCK

(71) Applicant: Achates Power, Inc., San Diego, CA (US)

(72) Inventor: Kevin B. Fuqua, San Diego, CA (US)

(73) Assignee: ACHATES POWER, INC., San Diego, CA (US)

( * ) Notice: Subject to any disclaimer, the term of this patent is extended or adjusted under 35 U.S.C. 154(b) by 179 days.

(21) Appl. No.: 14/450,572

(22) Filed: Aug. 4, 2014

(65) Prior Publication Data

US 2016/0032861 A1 Feb. 4, 2016

(51) Int. Cl.

| | |
|---|---|
| ***F02B 25/08*** | (2006.01) |
| ***F02F 7/00*** | (2006.01) |
| ***F02F 1/18*** | (2006.01) |
| ***F01B 7/14*** | (2006.01) |
| ***F02B 75/28*** | (2006.01) |

(52) U.S. Cl.

CPC ..... *F02F 7/0009* (2013.01); *F01B 7/14* (2013.01); *F02B 75/282* (2013.01); *F02F 1/18* (2013.01)

(58) Field of Classification Search

CPC ..... F02F 7/0009; F02F 1/18; F01B 7/14; F02B 75/28; F02B 75/282

USPC ..... 123/51 R–52.6 R

See application file for complete search history.

(56) References Cited

U.S. PATENT DOCUMENTS

| | | | | |
|---|---|---|---|---|
| 1,476,309 | A * | 12/1923 | Toth | 123/51 AA |
| 2,031,318 | A | 11/1929 | Junkers | |
| 2,226,333 | A * | 12/1940 | Byerman | 123/51 AA |
| 2,419,531 | A | 4/1947 | Bronander | 123/51 |
| 2,451,723 | A * | 10/1948 | Eagle | 74/665 N |
| 3,134,373 | A | 5/1964 | Schauer, Jr. | 123/51 |
| 4,677,948 | A | 7/1987 | Candea | |
| 4,836,159 | A | 6/1989 | Lobig | |
| 6,076,494 | A | 6/2000 | Kampichler et al. | |
| 6,099,374 | A * | 8/2000 | Watanabe et al. | 440/88 L |
| 6,109,231 | A * | 8/2000 | Watanabe et al. | 123/184.42 |
| 6,182,619 | B1 | 2/2001 | Spitzer et al. | 123/51 |
| 6,945,214 | B2 | 9/2005 | Sachdev et al. | |

(Continued)

FOREIGN PATENT DOCUMENTS

| | | |
|---|---|---|
| EP | 0 881 365 B1 | 4/2003 |
| EP | 2053219 A1 | 4/2009 |

(Continued)

OTHER PUBLICATIONS

Edume Nunez; Web Bearing and Buckling to BS EN Jan. 1993; NSC (New Steel Construction); May 2008; pp. 32,34; NSC0508tech; Barrett, Byrd Associates; Tunbridge Wells, UK.

(Continued)

*Primary Examiner* — Marguerite McMahon
(74) *Attorney, Agent, or Firm* — Terrance A. Meador

(57) ABSTRACT

An engine structure for a multi-cylinder, opposed-piston engine includes a cylinder block with a plurality of inline cylinders. Each cylinder has ends with an outside diameter and an intermediate portion between the ends of a relatively larger outside diameter than the ends. The cylinder block includes a bearing web structure that positions bearing web elements outside of a plane that longitudinally bisects all of the cylinders. The cylinder block is split into two sections so as to permit cylinder liners to be inserted into and removed from cylinder tunnels in the cylinder block.

5 Claims, 12 Drawing Sheets

(56) References Cited

U.S. PATENT DOCUMENTS

| | | | | |
|---|---|---|---|---|
| 7,104,239 | B2 | 9/2006 | Kawakubo et al. | |
| 2005/0132996 | A1 | 6/2005 | Sachdev et al. | |
| 2010/0282219 | A1* | 11/2010 | Alonso | 123/51 AA |
| 2011/0168109 | A1 | 7/2011 | Roth | |
| 2013/0025124 | A1 | 1/2013 | Nagel et al. | |

FOREIGN PATENT DOCUMENTS

| | | | |
|---|---|---|---|
| GB | 16909 | A | 5/1915 |
| GB | 252135 | A | 11/1926 |
| GB | 428609 | A | 5/1935 |
| GB | 584783 | A | 1/1947 |
| WO | WO 2009/061873 | A2 | 5/2009 |

OTHER PUBLICATIONS

International Search Report and Written Opinion for PCT application PCT/US2015/043170, mailed Feb. 9, 2016.

Response to Invitation to Provide Informal Clarification filed with the European Patent Office (ISA/EP) on Jan. 25, 2016.

* cited by examiner

OPPOSED-PISTON ENGINE STRUCTURE WITH A SPLIT CYLINDER BLOCK

RELATED APPLICATIONS

This application contains subject matter related to the subject matter of commonly-owned U.S. application Ser. No. 13/891,466, filed May 10, 2013 for "Placement of an Opposed-Piston Engine in a Heavy-Duty Truck", commonly-owned U.S. application Ser. No. 14/028,423, filed Sep. 16, 2013 for "A Compact, Ported Cylinder Construction for an Opposed-Piston Engine", commonly-owned U.S. application Ser. No. 14/284,058 filed May 21, 2014 for "Air Handling Construction For Opposed-Piston Engines" and commonly-owned U.S. application Ser. No. 14/284/134 filed May 21, 2014 for "Open Intake and Exhaust Chamber Construction for Air handling System of an Opposed-Piston Engine".

BACKGROUND

The field relates to two-stroke cycle, opposed-piston engines. Particularly, the field concerns a compact engine structure for an opposed-piston engine with a split cylinder block. The term "engine structure" is taken to mean an assembly including a cylinder block and associated crankcases. Further, a "crankcase" is a housing with a crankshaft and its associated main bearings.

A two-stroke cycle engine is an internal combustion engine that completes a cycle of operation with a single complete rotation of a crankshaft and two strokes of a piston connected to the crankshaft. The strokes are typically denoted as compression and power strokes. One example of a two-stroke cycle engine is an opposed-piston engine in which two pistons are disposed in the bore of a cylinder for reciprocating movement in opposing directions along the central axis of the cylinder. Each piston moves between a bottom center (BC) location where it is nearest one end of the cylinder and a top center (TC) location where it is furthest from the one end. The cylinder has ports formed in the cylinder sidewall near respective BC piston locations. Each of the opposed pistons controls one of the ports, opening the port as it moves to its BC location, and closing the port as it moves from BC toward its TC location. One of the ports serves to admit charge air into the bore, the other provides passage for the products of combustion out of the bore; these are respectively termed "intake" and "exhaust" ports (in some descriptions, intake ports are referred to as "air" ports or "scavenge" ports).

FIG. 1 illustrates a two-stroke cycle, opposed-piston engine 10. The engine 10 has a plurality of ported cylinders, one of which is indicated by reference numeral 50. For example, the engine may have two ported cylinders, or three or more ported cylinders. Each ported cylinder 50 has a bore 52 and longitudinally-spaced intake and exhaust ports 54 and 56 formed or machined near respective ends of a cylinder wall. Each of the intake and exhaust ports includes one or more circumferential arrays of openings or perforations. In some descriptions, each opening is referred to as a "port"; however, the construction of one or more circumferential arrays of such "ports" is no different than the port constructions shown in FIG. 1. Pistons 60 and 62 are slidably disposed in the bore 52 with their end surfaces 61 and 63 in opposition. The piston 60 controls the intake port 54, and the piston 62 controls the exhaust port 56. In the example shown, the engine 10 further includes two crankshafts 71 and 72. The intake pistons 60 of the engine are coupled to the crankshaft 71, and the exhaust pistons 62 to the crankshaft 72.

As the pistons 60 and 62 near their TC locations in the cylinder 50, a combustion chamber is defined in the bore 52 between the end surfaces 61 and 63 of the pistons. Fuel is injected directly into the combustion chamber. In some instances injection occurs at or near minimum volume (the point in the compression cycle where minimum combustion chamber volume occurs because the pistons end surfaces are nearest each other); in other instances, injection may occur before minimum volume. Fuel is injected through one or more fuel injector nozzles positioned in respective openings through the sidewall of the cylinder 50. Two such nozzles 70 are shown. The fuel mixes with charge air admitted into the bore 52 through the intake port 54. As the air-fuel mixture is compressed between the end surfaces 61 and 63, the compressed air reaches a temperature and a pressure that cause the fuel to ignite. Combustion follows.

With further reference to FIG. 1, the engine 10 includes an air handling system 80 that manages the transport of charge air to, and exhaust gas from, the engine 10. A representative air handling system construction includes a charge air subsystem 81 and an exhaust subsystem 82. In the air handling system 80, a charge air source receives intake air and processes it into pressurized air (hereinafter "charge air"). The charge air subsystem 81 transports the charge air to the intake ports of the engine. The exhaust subsystem 82 transports exhaust products from exhaust ports of the engine for delivery to other exhaust components. In some aspects, the air handling system 80 may be constructed to reduce undesirable emissions produced by combustion by recirculating a portion of the exhaust gas produced by combustion through an exhaust gas recirculation ("EGR") system 83. The recirculated exhaust gas is mixed with charge air to lower peak combustion temperatures, which reduces production of the undesirable emissions.

With reference to FIG. 2, an engine structure for a two-stroke cycle, dual-crankshaft, opposed-piston engine 90 includes a cylinder block 100, a crankcase assembly 102, and a crankcase assembly 104. The cylinder block 100 includes a plurality of cylinders 106 aligned in a row such that a single plane bisects, and contains the longitudinal axes of, all of the cylinders. The row-wise alignment of the cylinders 106 is referred to as an "inline" configuration in keeping with standard nomenclature of the engine arts. Furthermore, the inline arrangement can be "straight", wherein the plane containing the longitudinal axes is essentially vertical, or "slant", wherein the plane containing the longitudinal axes is slanted. It is also possible to position the engine in such a manner as to dispose the plane containing the longitudinal axes essentially horizontally, in which case the inline arrangement would be "horizontal". Thus, while the following description is limited to an inline configuration, it is applicable to straight, slant, and horizontal variations.

In this specification, a "cylinder" is taken to be constituted of a liner (sometimes called a "sleeve") retained in a cylinder tunnel formed in the cylinder block 100. The inline array of cylinders 106 is aligned with an elongate dimension L of the cylinder block 100. Taking the left-most cylinder 106 to be representative of all of the cylinders 106, each cylinder has a bore 152 and an annular intake portion including an intake port 154 separated along the longitudinal axis of the cylinder from an annular exhaust portion including an exhaust port 156. The end of the cylinder nearest the intake port 154 is referred to as the "intake end" of the cylinder, and the end nearest the exhaust port 156 is referred to as the "exhaust end". The cylinders 106 are arranged such that their intake and exhaust ends are aligned in respective sides of the inline array. Two counter-moving pistons 160 and 162 are disposed in the liner bore of each cylinder. The pistons 160 control the intake ports of the engine; the pistons 162 control the exhaust ports. A crankshaft 171 is rotatably supported by main bearings B1 along the intake end of the cylinders 106, in parallel alignment with the elongate dimension L. All of the pistons 160 are coupled to the crankshaft 171. A crankshaft 172 is rotatably supported by main bearings B2 along the intake end of the cylinders 106, in parallel alignment with the elongate dimension L. All of the pistons 162 are coupled to the crankshaft 172. The crankshafts 171 and 172 are coupled by a gear train 175, or by other equivalent means including one or more of a beveled gear drive, a belt, and a chain.

The crankcase assembly 102 includes the crankshaft 171 and the main bearings B1. The crankcase assembly 104 includes the crankshaft 172 and the main bearings B2. The engine structure may also include a gear box 105 housing the gear train 175. In such a case, the gear box 105 may extend over a face of the cylinder block 100, between the crankcase assemblies 102 and 104.

The inline, dual-crankshaft engine structure shown in FIG. 2 differs substantially from the standard inline and V structures of two- and four-stroke engines in which each cylinder contains only a single piston and all pistons are connected to a single crankshaft. The structural differences are especially in evidence when considering the difficulty of fitting the two-stroke cycle opposed-piston engine structure of FIG. 2 to vehicle engine compartment space configured for standard inline and V engine structures. In this regard, see related application U.S. application Ser. No. 14/028,423. Further, even when not constrained by predetermined engine compartment configurations, the opposed-piston engine structure of FIG. 2 can be difficult to fit to a vehicle. Therefore, it is important to make the opposed-piston engine structure as compact as possible so as to occupy minimal space in applications such as vehicles, locomotives, maritime vessels, stationary power sources, and so on.

As per FIG. 2, one step in achieving a compact engine structure for the illustrated engine is to minimize the center-to-center spacing between the cylinders 106 so as to reduce the elongate dimension L of the cylinder block 100. There are, however, at least two impediments to this solution. First, the high pressures produced during combustion may lead to constructions that strengthen the cylinders, especially around the cylinder zones where the pistons are at or near TC. As seen in FIG. 3, this can lead to a cylinder structure that includes a liner 200 equipped with a compression sleeve 202 configured with intake and exhaust ports 203 and 205, respectively, girding an intermediate liner portion between the cylinder's intake and exhaust ends 204 and 206. These parts share a common longitudinal axis 207. The compression sleeve 202 results in an outer diameter $D_M$ in the intermediate portion of the liner that is larger than the outer diameter $D_E$ of the two ends 204 and 206. The second impediment is raised by provision of a bearing web structure capable of withstanding the forces applied to the cylinder block by the main bearings. In the bearing web structure of FIG. 2 the web elements 180 (sometimes called "bearing partitions") extend from main bearings B1 to main bearings B2, passing between the cylinders 106. In view of these elements, the minimum center-to-center cylinder bore spacing is greater than the sum of the diameter $D_M$ of a compression sleeve 202 (FIG. 3) and the thickness of a bearing web member 180 (FIG. 2).

SUMMARY

Manifestly, it would be advantageous to reduce constraints on the minimum center-to-center cylinder bore spacing of an engine structure according to FIG. 2 to enable a more compact, multi-cylinder, opposed-piston engine structure equipped with strengthened cylinder structures.

The following specification describes an engine structure for a multi-cylinder, opposed-piston engine which includes a cylinder block having a bearing web structure which positions bearing web elements outside of a plane bisecting the cylinders longitudinally. As a result, reduction of inter-cylinder spacing is no longer limited by bearing web elements. However, the structural integrity of the cylinder block is preserved by repositioning bearing web elements toward opposing sides of the engine block. At the same time, an increase in engine power is achieved by provision of cylinder structures that include liners with compression sleeves girding their intermediate portions.

In the prior art, cylinder Liners with constant diameters can be slid into and out of cylinder tunnels through one end of a monolithic cylinder block. However, in order to be able accommodate cylinder liners with widened intermediate portions resulting from provision of compression sleeves, without surrendering the advantage gained by repositioning the bearing web elements, the cylinder tunnels according to this specification are formed in the cylinder block in the shape of the liners; that is to say, with intermediate portions that are wider than their end portions.

Thus, it becomes useful to provide a cylinder block split into two separate sections along a plane passing through the wide intermediate portions of the cylinder tunnels. The two sections are fastened together to provide a complete, integral cylinder block. When inserting original cylinder liners or replacing worn ones, the cylinder block is disassembled into its two sections so that the wide intermediate parts of the liners needn't pass though the narrower end portions of the cylinder tunnels. The cylinder block is then reassembled with the cylinder liners captured and retained between the two cylinder block sections. Fasteners that hold the cylinder block sections together act between the cylinder block sections through the bearing web members to capture the heavy loads of the crankshafts.

DETAILED DESCRIPTION

This specification concerns a two-stroke cycle, dual crankshaft, opposed-piston engine with an engine structure including a cylinder block that has a plurality of cylinders arranged inline along an elongate dimension of the engine, a first crankcase extending along one end of the cylinders and a second crankcase extending along a second end of the cylinders. The cylinder block includes a bearing web structure in which each bearing web includes a member that extends from a first main bearing in the first crankcase to a second main bearing in the second crankcase, and passes along opposing sides of the cylinder block. A bearing web includes at least two apertures that define spaced-apart bearing members running between first and the second main bearing pedestal portions that are positioned between opposing sides of the cylinder block and a plane longitudinally bisecting the cylinders. Preferably, each aperture includes an arch connecting the spaced-apart bearing members and supporting a main bearing pedestal.

Figure 1:
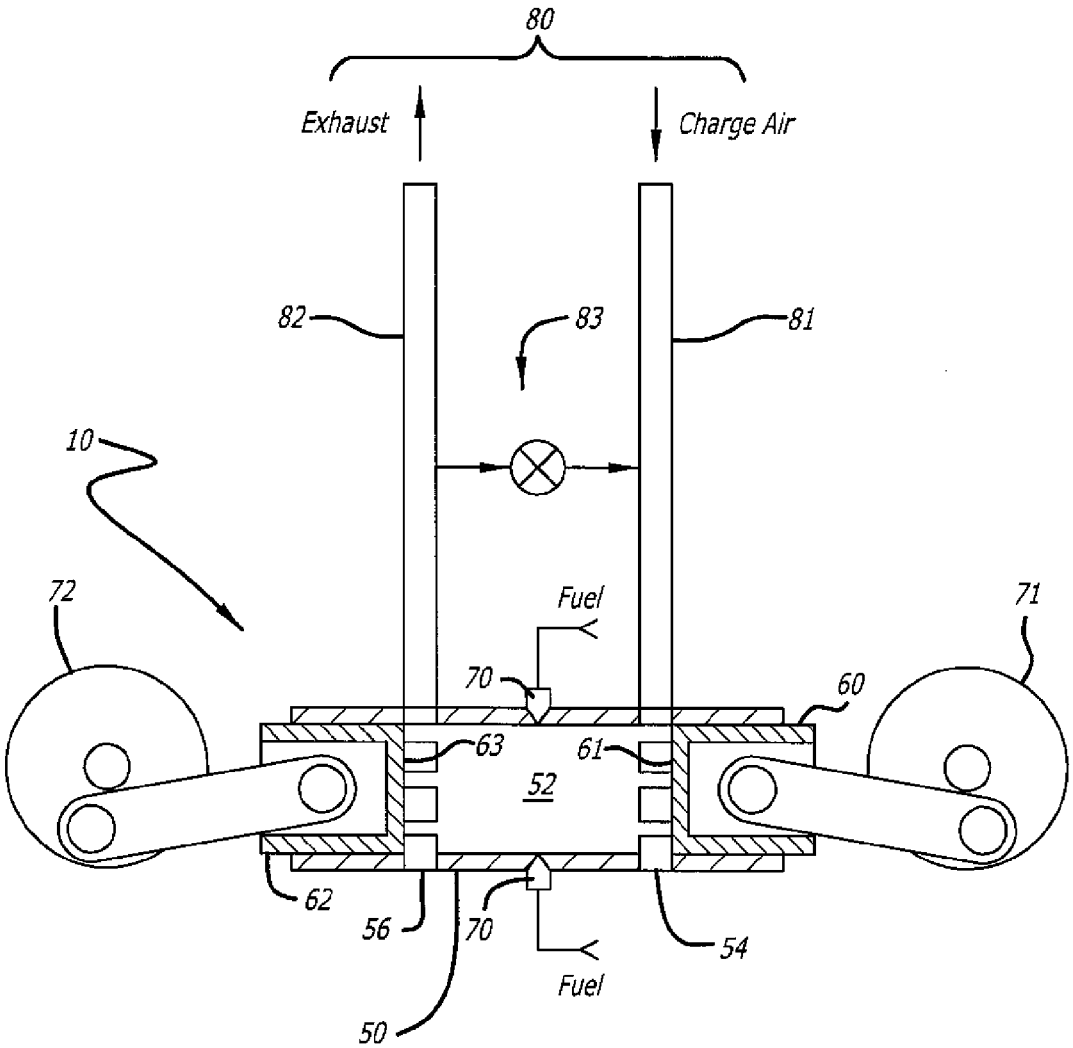
FIG. 1 (Prior Art)
FIG. 1 is a schematic diagram of a two-stroke cycle, opposed-piston engine, and is appropriately labeled "Prior Art".
Figure 2:
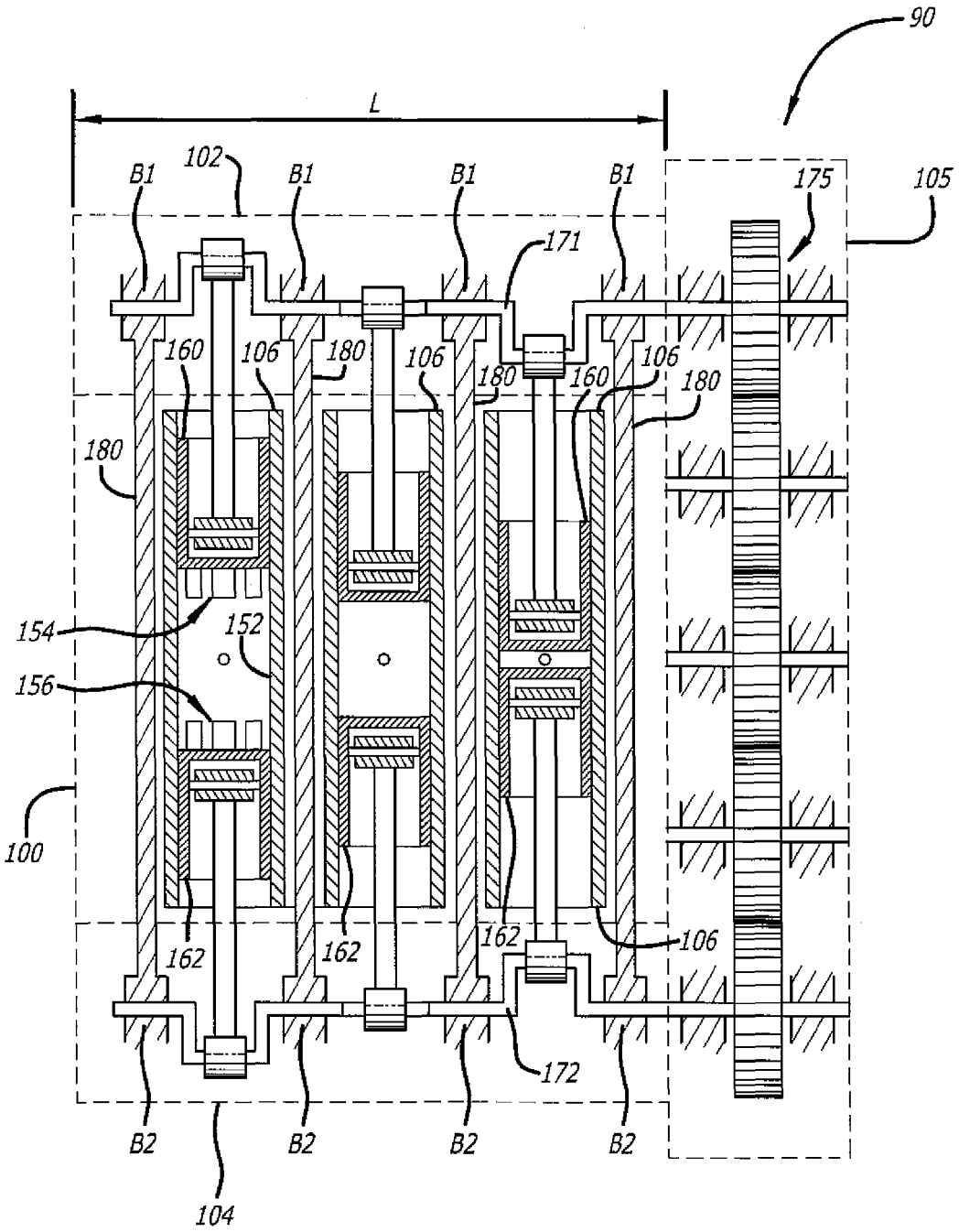
FIG. 2 (Prior Art)
FIG. 2 is a schematic diagram representing a longitudinal section of a cylinder block of an opposed-piston engine, and is appropriately labeled "Prior Art".
Figure 4:
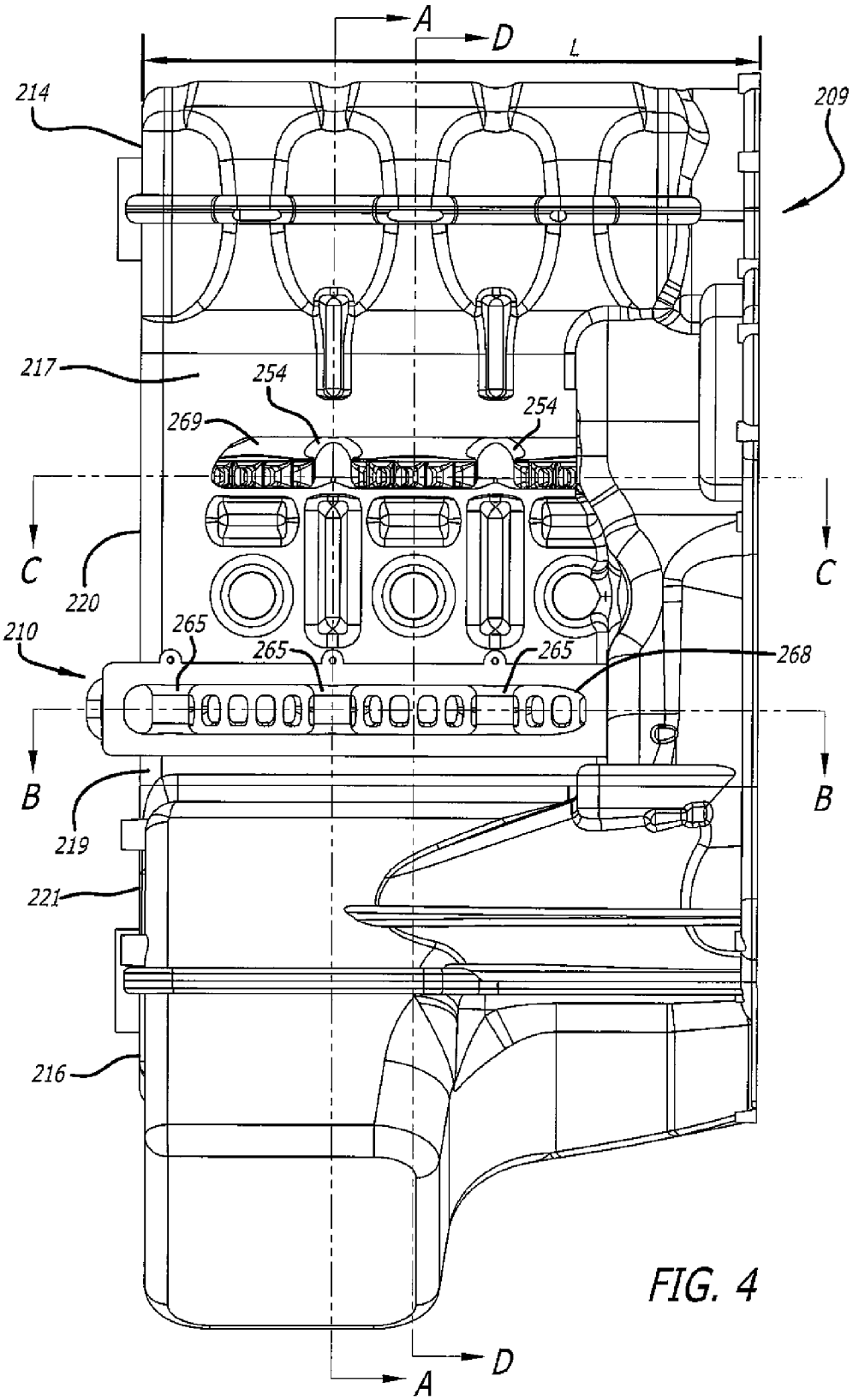
FIG. 4 is an elevation view of one side of an engine structure for an opposed-piston engine according to this disclosure.

Referring to the drawings, FIG. 4 is a side elevation view of an engine structure for an opposed-piston engine according to the present disclosure. The vertical orientation of the engine structure in this and other figures of this disclosure is only for purposes of illustration and explanation and is not meant to limit the principles described and illustrated herein only to such an orientation. Further, pistons and connecting rods are omitted from this description in order to more clearly illustrate certain features of the cylinder block, with the understanding that a fully equipped engine structure would include these elements-as per FIG. 2, for example. The engine structure 209 includes a cylinder block 210 with crankcase assemblies 214 and 216. The engine structure can be made with standard industrial methods including casting, molding, and or machining using materials such as cast iron, aluminum, or other equivalent materials. Various parts of the engine structure can also be made by the same or similar methods using the same or similar materials.

Figure 5:
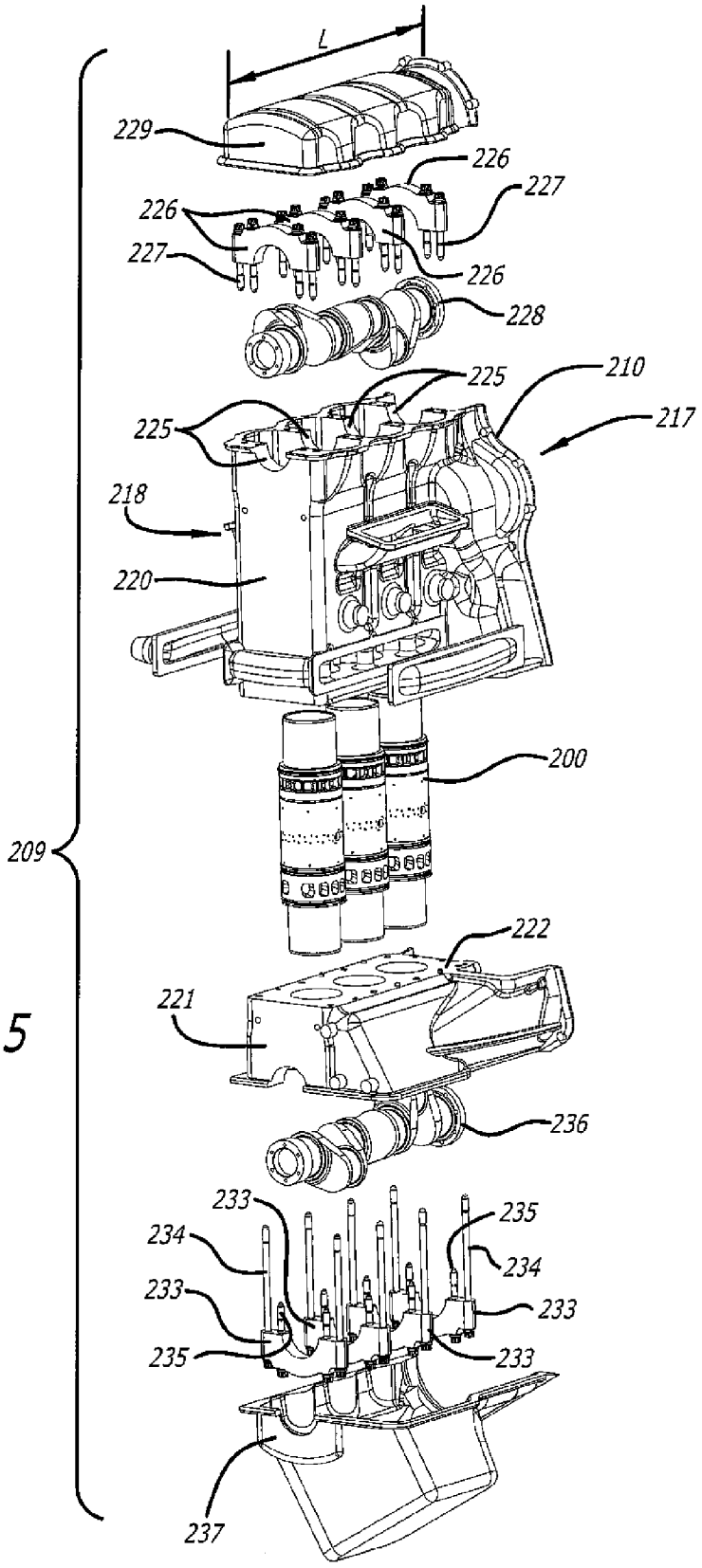
FIG. 5 is an exploded perspective view of the engine structure of FIG. 4.
Figure 6:
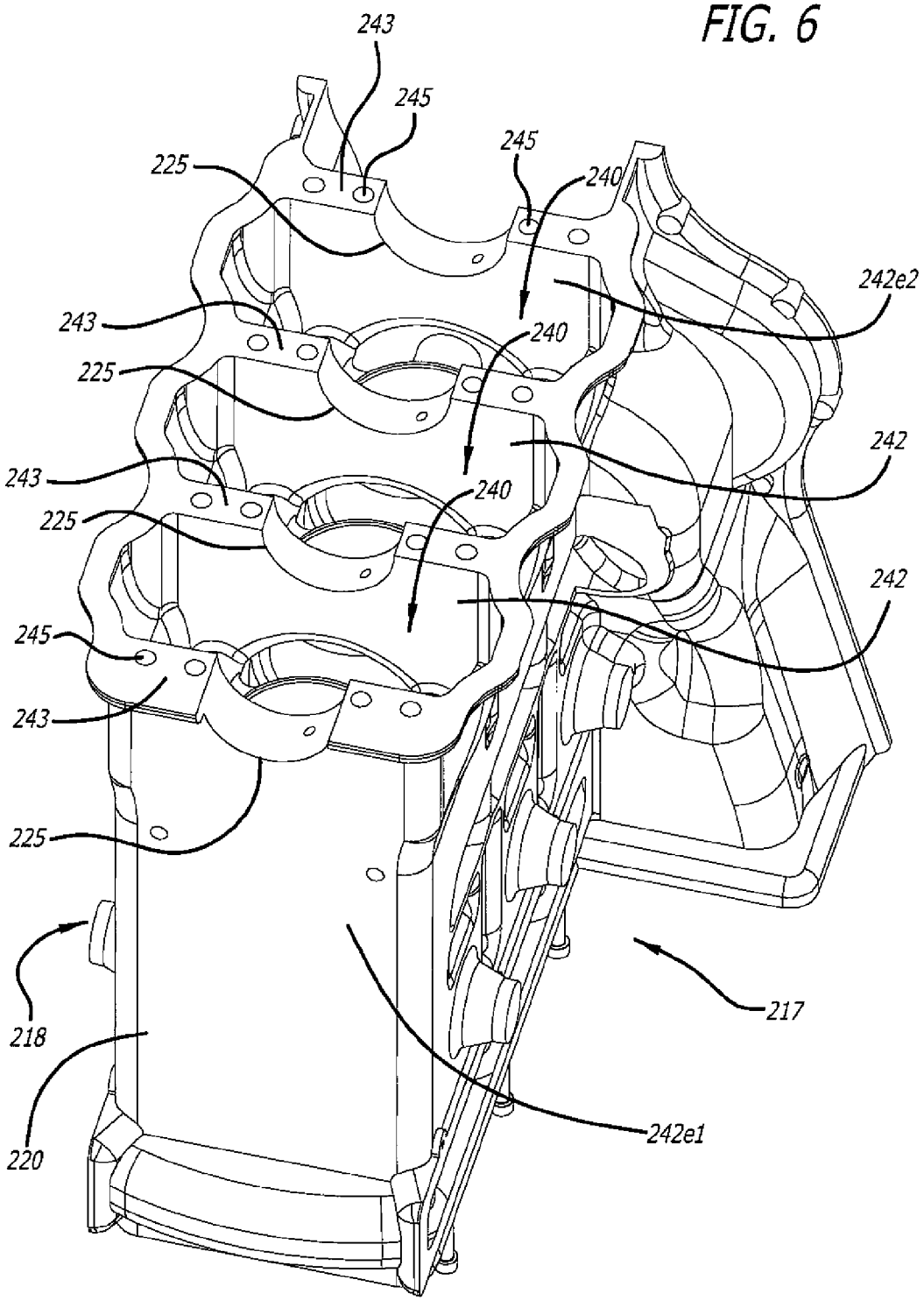
FIG. 6 is a perspective view of a first section of a cylinder block of the engine structure of FIG. 4.
Figure 7:
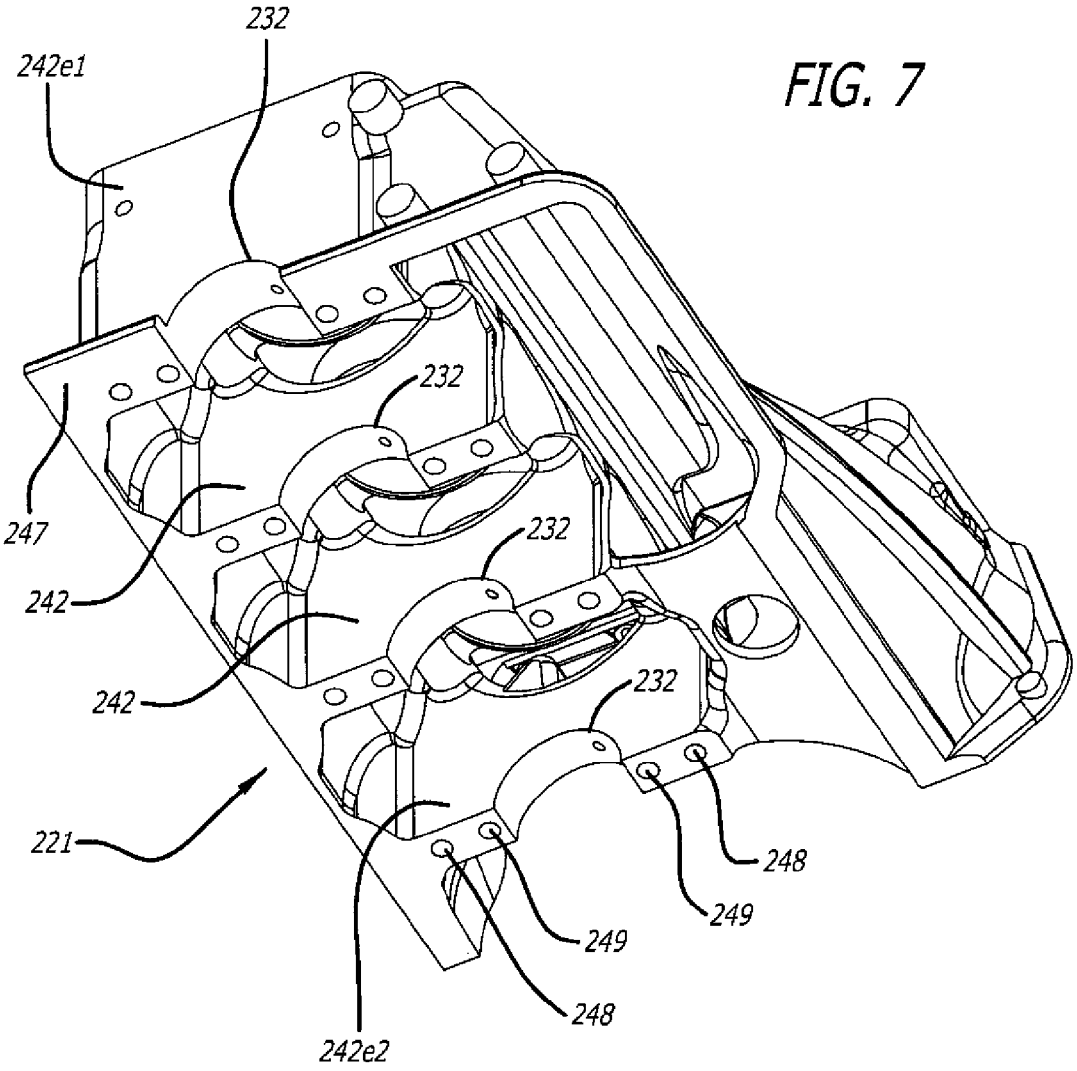
FIG. 7 is a perspective view of a second section of a cylinder block of the engine structure of FIG. 4.

As per FIGS. 4 and 5, the cylinder block 210 has an elongate dimension L and opposing sides 217 and 218 that extend in the longitudinal direction. A plurality of cylinders including liners 200 is disposed in the block 210 in an inline array along the elongate dimension L. As per FIGS. 5, 6, and 7, the cylinder block 210 is split at 219 into two block sections 220 and 221, with the liners 200 retained in cylinder tunnels in the cylinder block between the block sections 220 and 221. With reference to FIGS. 4, 5 and 6, the crankcase assembly 214 includes main bearings that are constituted of main bearing pedestal portions 225 and main bearing caps 226. The main bearing caps 226 are secured over the main bearing pedestal portions 225 by threaded fasteners 227 so as to rotatably support the crankshaft 228. A cover 229 encloses the main bearings 225, 226 and the crankshaft 228. With reference to FIGS. 4, 5 and 7, the crankcase assembly 216 includes main bearings that are constituted of main bearing pedestal portions 232 and main bearing caps 233. The main bearing caps 233 are secured over the main bearing pedestal portions 232 by threaded fasteners 234 and 235 so as to rotatably support the crankshaft 236. A cover 237 encloses the main bearings 232, 233 and the crankshaft 236.

With reference to FIGS. 4-9, the cylinder block has an internal structure including a plurality of cylinder tunnels 240 and a plurality of bearing web members 242 interdigitated with the cylinder tunnels. The cylinder tunnels 240 are arranged inline along the elongate dimension L. Each bearing web member is a plate or a wall of the cylinder block that extends from the crankcase assembly 214 to the crankcase assembly 216, from the side 217 to the side 218. Each bearing web member has a first end surface 243 in which are formed a main bearing pedestal portion 225 and fastener apertures 245 that receive the fasteners 227. Each bearing web member has a second end surface 247, opposite the first end surface 243, in which are formed a main bearing pedestal portion 232 and fastener apertures 248 and 249 that receive the fasteners 234 and 235.

Figure 3:
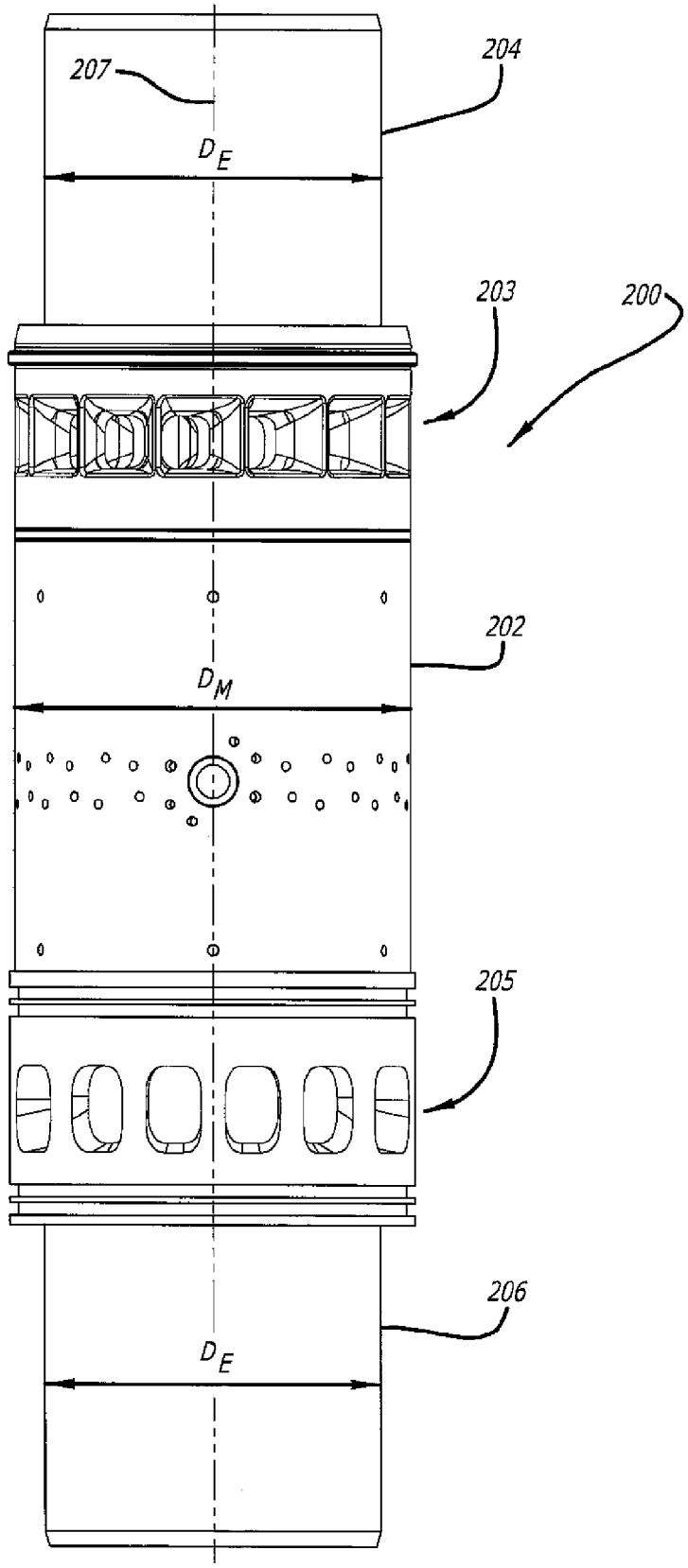
FIG. 3 is an elevation view of a ported cylinder liner equipped with a compression sleeve for an opposed-piston engine.
Figure 8:
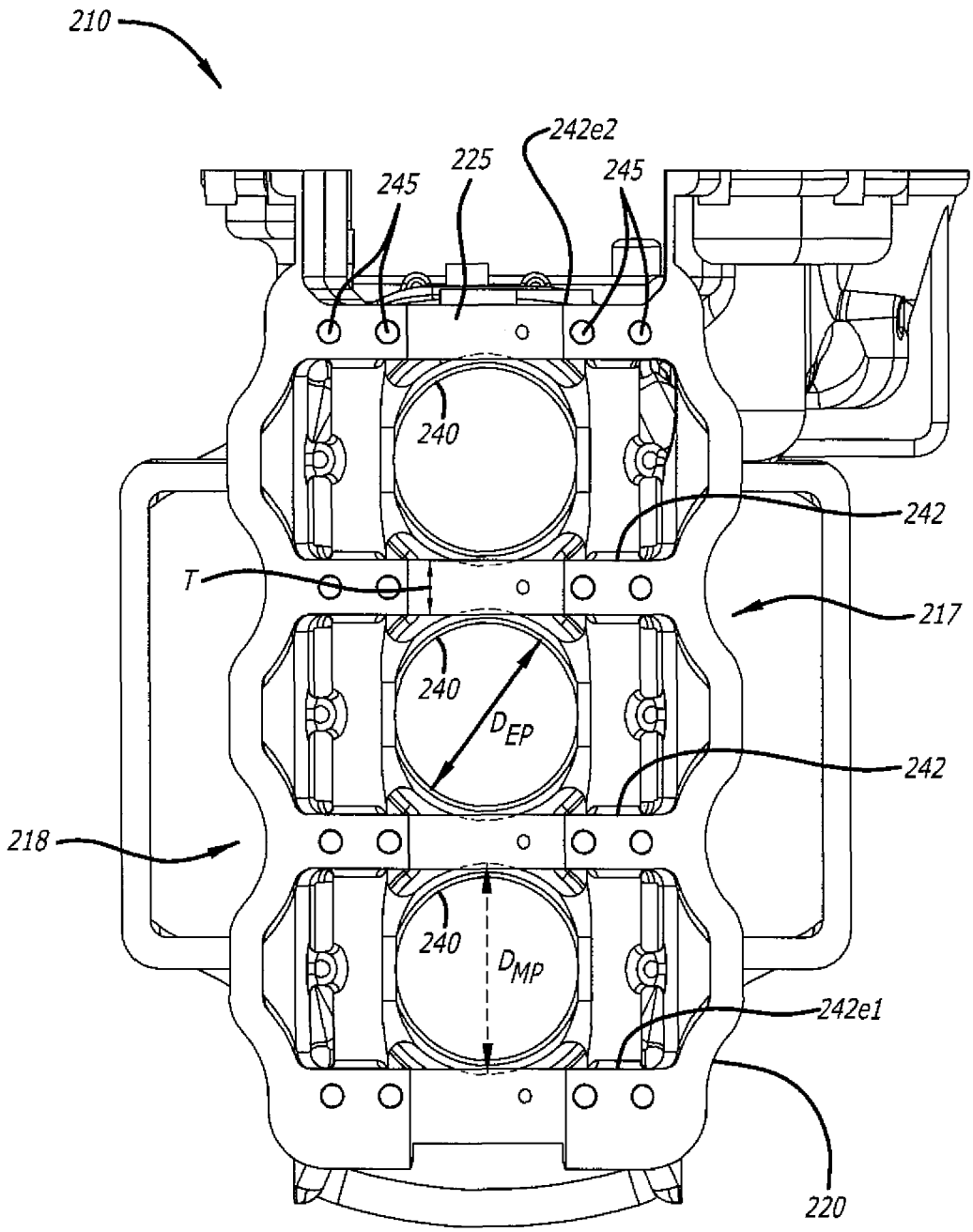
FIG. 8 is a plan view of a first face of the first cylinder block section of FIG. 6.
Figure 9:
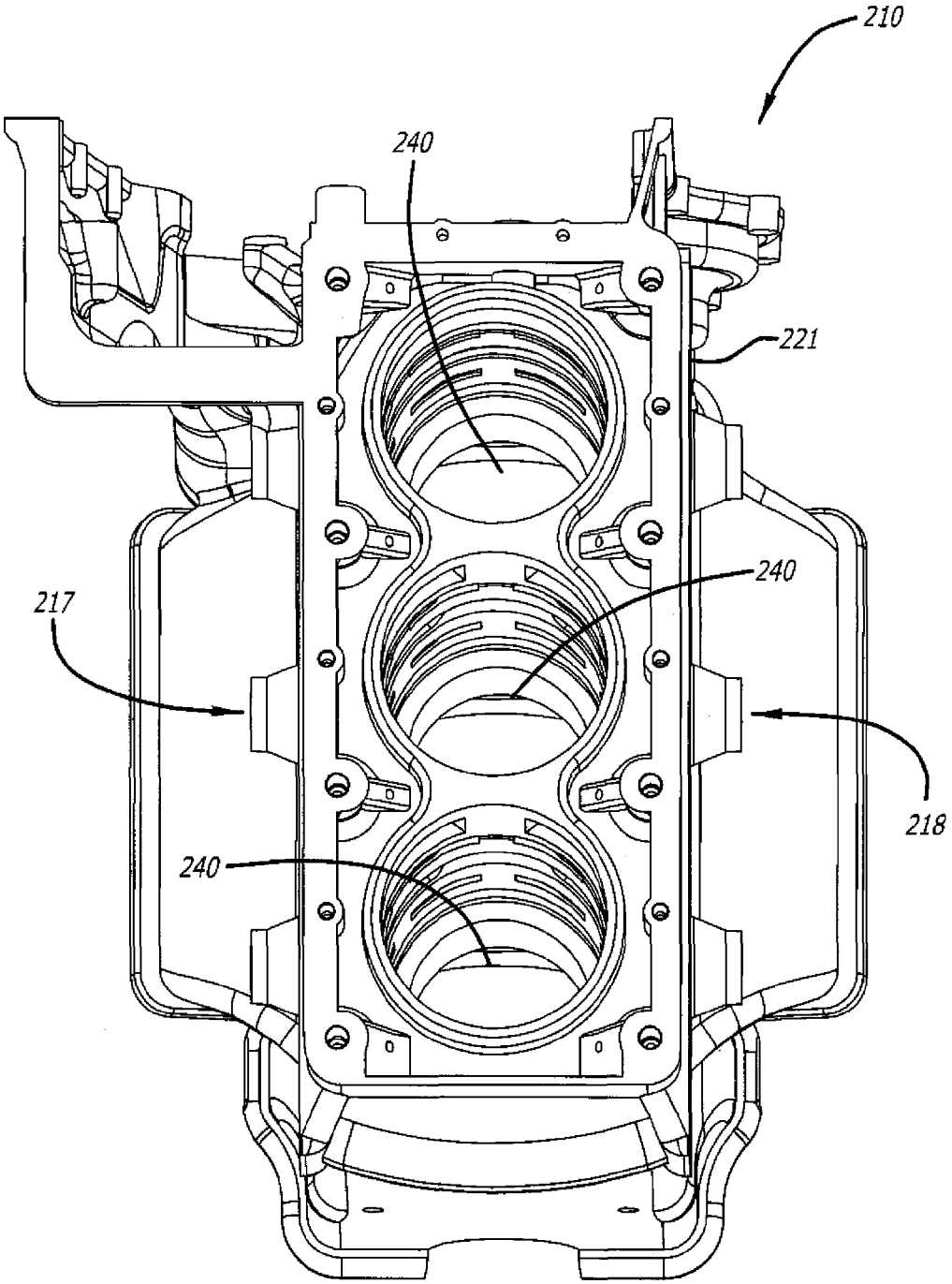
FIG. 9 is perspective view of a second face of the first cylinder block section that is opposite the first face.

With reference to FIGS. 8 and 9, the structure of each of the tunnels 240 is conformed to the liner construction illustrated in FIG. 3 in that each tunnel 240 includes two cylindrical end portions separated by a cylindrical intermediate portion that is coaxial with the end portions. The intermediate portion has a diameter $D_{MP}$ that is greater than the diameter $D_{EP}$ of the end portions. The structure of the bearing web members 242 accommodates the larger diameter of the middle portion of a cylinder tunnel without interposing the full thickness T of a web bearing member between adjacent tunnels, while bearing the loads exerted on the crankshafts during engine operation. In this regard, as shown in FIG. 10, the bearing loads borne by each bearing web member are resolved by means of a pair of opposed arches into separate force vectors V that are directed along the opposing sides 217 and 218 of the cylinder block 210.

Figure 10:
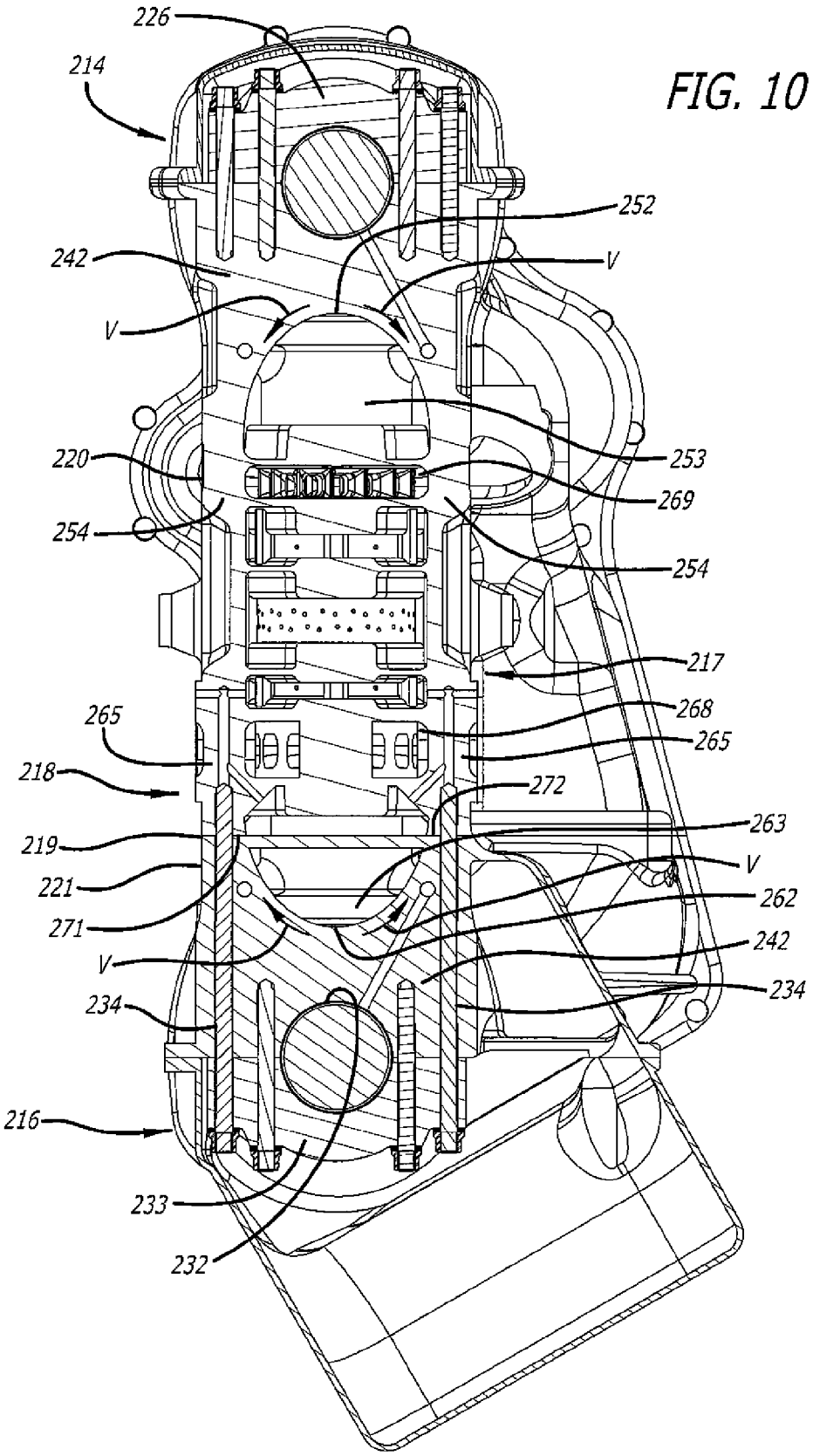
FIG. 10 is a cross section through the engine structure of FIG. 4 at lines A-A showing the structure of a bearing web according to this disclosure.
Figure 13:
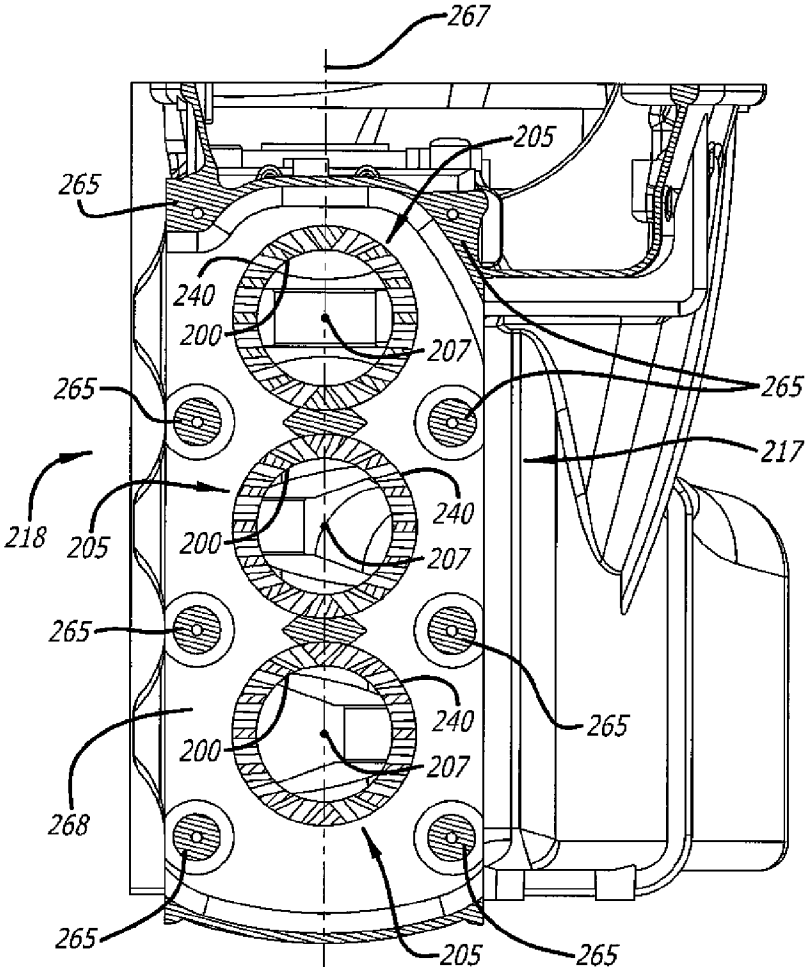
FIG. 13 is a cross section through the engine structure of FIG. 4 at lines B-B showing the structure and location of bearing web members in an exhaust chamber according to this disclosure.
Figure 12:
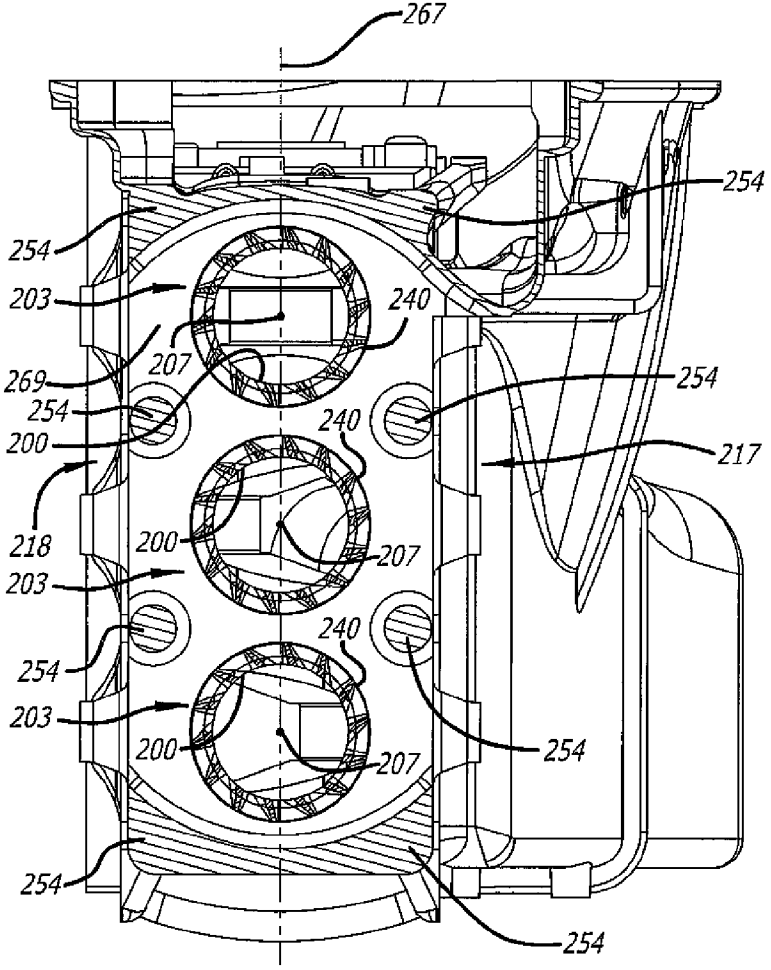
FIG. 12 is a cross section through the engine structure of FIG. 4 at lines C-C showing the structure and location of bearing web members in an intake chamber according to this disclosure.

The structure of a web bearing member is best seen in FIGS. 10 and 12-13, where the member 242 includes an arch 252 spanning an opening 253. The arch 252 is oriented with its keystone portion nearest the crankcase 214 and its span facing the crankcase 216. Laterally-separated pier portions 254 of the arch extend along the opposing sides 217 and 218, respectively, of the cylinder block 210 in the direction of the crankcase 216. The member 242 further includes an arch 262 spanning an opening 263. The arch 262 is oriented with its keystone portion nearest the crankcase 216 and its span facing the crankcase 214. Laterally-separated pier portions 265 of the arch 263 extend along the opposing sides 217 and 218, respectively, of the cylinder block 210 in the direction of the crankcase 214. As seen in FIGS. 10, 12, and 13, the pier portions 254 and 265 of each bearing member 242 extend between the arches 252 and 262 and meet to form spaced-apart bearing members that are positioned between opposing sides 217 and 218 of the cylinder block and a plane 267 longitudinally bisecting the cylinders and containing their longitudinal axes 207.

It is not necessarily the case that the opposed arch openings of a bearing web member 242 extend fully through the member. For instance as can be appreciated with reference to FIGS. 6, 7, and 8, the arch openings of the outermost web members $\mathbf{242}_{e1}$ and $\mathbf{242}_{e2}$ that also serve as the end faces of the cylinder block 210 would be cut into the inner surfaces that face the interior of the cylinder block 210, but would not extend entirely through those members. However, the arch openings of the remaining web members may extend entirely through those members. Further, the semi-circular shape of the arches is not necessarily limiting as other arch shapes may be used according to various engine designs.

FIGS. 12 and 13 clearly show the desired result of reducing inter-cylinder spacing by removing bearing web structure from between the cylinders 200, 240. However, another benefit is realized from this solution. For reasons set forth in related U.S. application Ser. Nos. 14/284,058 and 14/284/134, is desirable to provide open chambers in the cylinder block 210 for circulation of charge air among the intake ports and for collection and transport of the products of combustion discharged through the exhaust ports. In this regard, the prior art bearing web structures shown in FIG. 2 partitioned the intake region of the cylinder block into individual compartments, each enclosing the intake port of an individual cylinder and preventing circulation of charge air between the cylinders. The exhaust region of the block was similarly constructed. With reference to FIGS. 4, 10, 12, and 13, sections of the pier portions 254 pass through an open intake chamber 269 in the cylinder block 210 containing all of the intake ports 203 of the cylinder liners 200. The elimination of bearing web structure between the intake ports frees up inter-cylinder space for circulation of charge air to all of the intake ports. The pier portion sections 254 serve as posts that support the opposing floor and ceiling of the intake chamber. Sections of the pier portions 265 pass through an open exhaust chamber 268 containing all of the exhaust ports 205 of the cylinder liners 200. The elimination of bearing web structure between the exhaust ports frees up inter-cylinder space for collection and transport of exhaust products. The pier portion sections 265 serve as posts that support the opposing floor and ceiling of the exhaust chamber.

Figure 11:
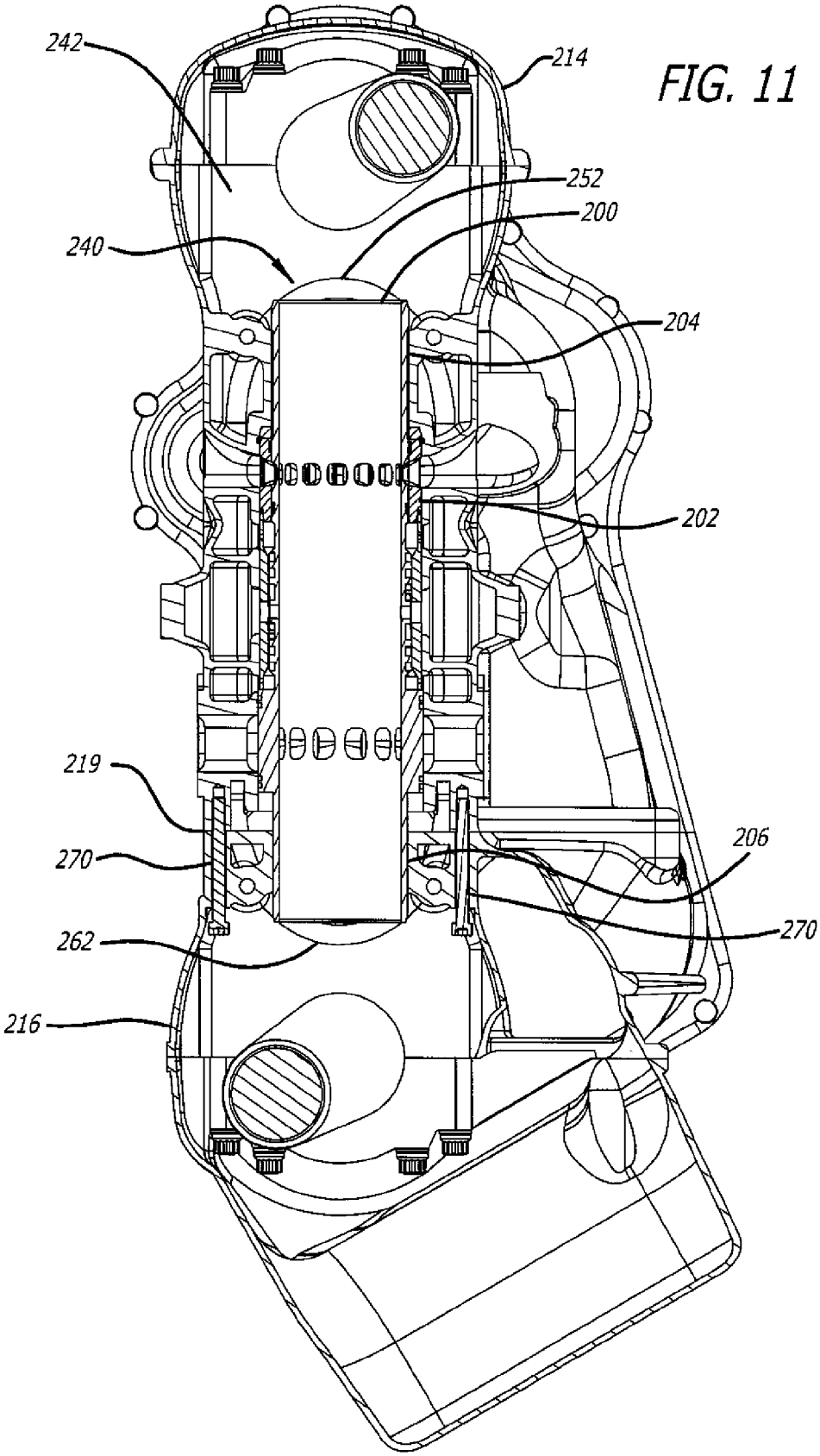
FIG. 11 is a cross section through the engine structure of FIG. 4 at lines D-D showing the structure of a cylinder according to this disclosure.

In order to enable a cylinder liner according to FIG. 3 to be inserted into or removed from the cylinder block of FIGS. 4 and 5, the cylinder block 210 is split and separable into the two block sections 220 and 221 at a seam 219 defined on a plane that is orthogonal to the axes of all of the cylinders and passes through the intermediate portions of the cylinders. As best seen in FIG. 10, the seam 219 is formed by abutment of the surface 271 of the block section 220 and the surface 272 of the block section 221. As best seen in FIGS. 10 and 11, the two block sections 220, 221 are secured together by threaded fasteners 234 and 270. To seat a cylinder liner 200 in a tunnel, the fasteners 234 and 270 are removed, the block sections 220 and 221 are separated, and the liner 200 is slid into the intermediate portion of a cylinder tunnel in one of the block sections and seated. The block sections 220 and 221 are then fixed together by the threaded fasteners 234 and 270, thereby securing the liner 200 in the cylinder tunnel. As per the example of FIGS. 10 and 11, when the engine structure 210 is assembled so as to retain the liners 200, the intake and exhaust ends 204 and 206 of the cylinder liners are positioned in the small-diameter ends of the tunnels, between successive pairs of web bearing members, with the intermediate portions in the large-diameter.

With regard to FIGS. 10 and 11, it should be evident that the loads on the fasteners 234 and 270 are quite high, since they bear the crankshaft forces during engine operation. For this reason, it is useful that the outer bolts 234 of the four-bolt bearing cap portions 233 of the crankcase assembly 216 are extended through the main bearings 232, 233 in the crankcase assembly 221, into bearing webs 242 in the vicinity of the arches 262, to join the two cylinder block sections 220 and 221 together. By using long fasteners that thread into the cylinder block section 220 and pass through the cylinder block section 221, these anticipated loads are well controlled.

Although features of a novel engine structure have been described with reference to presently preferred embodiments, it should be understood that various modifications can be made without departing from the spirit of the described features. Accordingly, any patent protection accorded to these features is limited only by the following claims.

The invention claimed is:

1. An engine structure for an opposed-piston engine, comprising:

a cylinder block having opposing sides extending in an elongate dimension, L, of the cylinder block;

the cylinder block including a plurality of cylinders, each cylinder including longitudinally separated intake and exhaust ends and an intermediate portion between the intake and exhaust ends;

the plurality of cylinders being arranged an inline array along the elongate dimension, L, of the cylinder block, between the opposing sides of the cylinder block, such that the intake and exhaust ends of the cylinders are aligned in respective first and second sides of the inline array;

a first crankcase assembly aligned with the elongate dimension and disposed along the first side of the inline array;

a second crankcase assembly aligned with the elongate dimension and disposed along the second side of the inline array; and, the cylinder block including a plurality of bearing webs interdigitated with the cylinders;

in which each cylinder comprises a cylinder tunnel formed in the cylinder block and a cylinder liner retained in the cylinder tunnel and all of the cylinders have a first diameter in the intermediate portions, a second diameter in the intake and exhaust ends, and the first diameter is larger than the second diameter; and, in which the cylinder block is split into two block sections at a seam defined on a plane that is orthogonal to the axes of all of the cylinders and passes through the intermediate portions of the cylinders.

2. The engine structure of claim 1, including a plurality of fasteners that secure the two block sections together.

3. The engine structure of claim 2 in which fasteners of the plurality of fasteners extend from main bearings in the second crankcase into the bearing webs of the cylinder block.

4. The engine structure of claim 2, further comprising an open intake chamber in the cylinder block containing all of the intake ports and an open exhaust chamber in the cylinder block containing all of the exhaust ports.

5. The engine structure of claim 1, further comprising an open intake chamber in the cylinder block containing all of the intake ports and an open exhaust chamber in the cylinder block containing all of the exhaust ports.

* * * * *